US005669294A

United States Patent [19]

Klemm et al.

[11] Patent Number: 5,669,294

[45] Date of Patent: Sep. 23, 1997

[54] PROCESS FOR SUPPLYING ENERGY TO ELECTRONICALLY CONTROLED PRESS DRIVES

[75] Inventors: Peter Klemm, Stuttgart; Burkhard Schumann, Ottenbach, both of Germany

[73] Assignee: Schuler Pressen GmbH & Co., Germany

[21] Appl. No.: 679,723

[22] Filed: Jul. 12, 1996

[30] Foreign Application Priority Data

Jul. 20, 1995 [DE] Germany ..... 195 26 491.6

[51] Int. Cl.[6] ..... B30B 15/30

[52] U.S. Cl. ..... 100/35; 100/45; 100/48; 100/53; 100/215

[58] Field of Search ..... 100/35, 43, 45, 100/48, 53, 207, 215

[56] References Cited

U.S. PATENT DOCUMENTS

| | | | |
|---|---|---|---|
| 3,948,162 | 4/1976 | Numba | 100/45 |
| 4,253,891 | 3/1981 | Brussel | 100/45 |
| 4,387,632 | 6/1983 | Heiberger | 100/45 |
| 4,414,887 | 11/1983 | Orii | 100/45 |
| 4,654,569 | 3/1987 | Mizumoto et al. | 100/45 |
| 5,048,410 | 9/1991 | Teramoto et al. | 100/53 |

FOREIGN PATENT DOCUMENTS

| | | | |
|---|---|---|---|
| 55-75897 | 6/1980 | Japan | 100/207 |

*Primary Examiner*—Stephen F. Gerrity
*Attorney, Agent, or Firm*—Evenson, McKeown, Edwards & Lenahan, P.L.L.C.

[57] ABSTRACT

A process supplies energy to electronically controlled drives, particularly drives for workpiece handling devices, in and on a press having a press slide. The workpiece handling devices are electromechanically driven and electronically controlled. In the event of a power supply system outage, at least the workpiece handling devices are supplied at least for a short time by an intermediate circuit of a drive amplifier or an uninterruptable power supply system with voltage. Thereby, all devices important for the movement of the workpiece handling devices are supplied with voltage from the intermediate circuit or the uninterruptable power supply system.

20 Claims, 1 Drawing Sheet

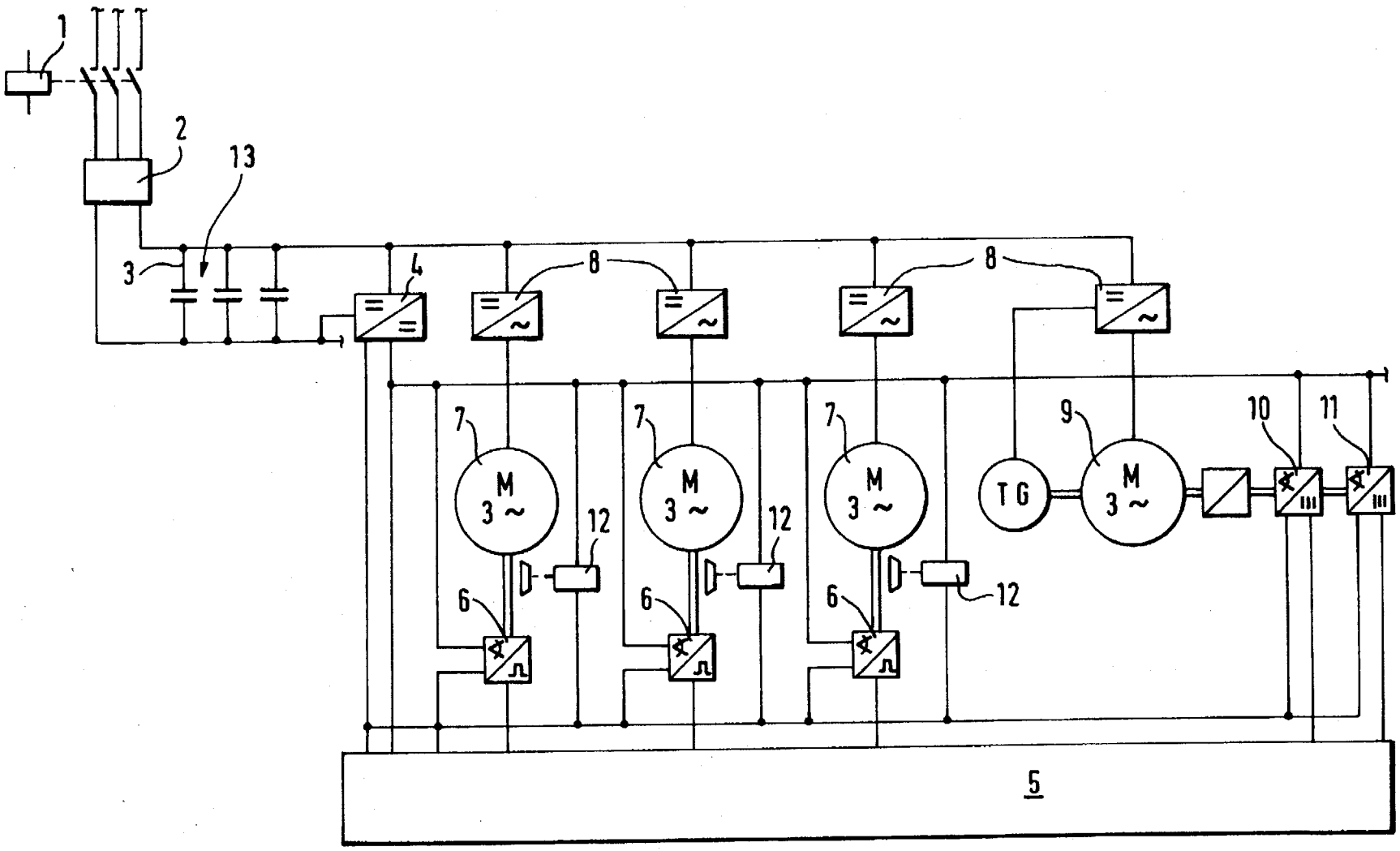
1
2
3
4
5
6
7
8
9
10
11
12
13
M
3~
TG

PROCESS FOR SUPPLYING ENERGY TO ELECTRONICALLY CONTROLED PRESS DRIVES

BACKGROUND AND SUMMARY OF THE INVENTION

The present invention relates to a process for supplying electronically controlled drives, particularly drives for workpiece handling devices, in and on a press with energy. More specifically, the workpiece handling devices are driven electromechanically and are controlled electronically, and the press has a slide.

Differently constructed workpiece handling devices for moving workpieces in presses are known. These workpiece handling devices are driven electromechanically and transport the workpiece into the press, from one station of a multistage press to the next station, and again out of the press.

The known workpiece handling devices also move through the moving area of the press dies and other moved components of the press. In the normal operation, the movements of the individual components are appropriately adapted with one another, i.e. synchronized by suitable devices.

When, however, electric power fails, e.g., in the event of a power supply system outage, the drives and the superimposed control of the press will no longer operate. In this situation, the electric synchronization of the individual drives of the press as well as of the workpiece handling devices will be terminated. The drives are separated from the power supply system, and the individual drives brake mechanically by way of holding brakes operating with spring pressure in an unguided manner to zero rotational speed.

Also during a power failure, the coupling for the press is switched off, and the press slide continues to move with a certain slowing down angle or slowing down path as a function of the momentary stroke number.

Therefore, depending on the position of the press slide at the point in time of the electric energy failure, there is the danger of a collision of the top tool of the press with the electronically controlled workpiece handling devices which, during a power outage, also continue to move in an uncontrolled and therefore uncoordinated manner with respect to the press slide. Collisions of this type may cause serious damage to the press or to individual press parts so that the press will no longer be available for the production and a corresponding economic damage will occur.

It is, therefore, an object of the present invention to provide a process for supplying electronically controlled drives, particularly drives for workpiece handling devices, in and on a press with energy, by way of which the components or subassemblies endangered by collision can be supplied with energy until they are situated in an area which is collision-free.

According to the present invention, this object has been achieved by providing that in the event of a power supply outage, supplying at least the workpiece handling devices with voltage by one of an intermediate circuit of a drive amplifier and a uninterruptable power supply, and supplying all devices essential for movement of the workpiece handling devices with the voltage from the one of the intermediate circuit and the uninterruptable power supply.

Because at least the workpiece handling devices are supplied with voltage from the intermediate circuit at least for a short time, that is, until they were moved into a collision-free area, collisions between the press slide and other components of the press can be avoided.

Inasmuch as all other devices which are important for the movement of the workpiece handling devices also continue to be supplied with voltage even in the event of a power supply failure, all devices can be moved into a defined basic position. Thereby, the press can be started again from this basic position without any problems.

BRIEF DESCRIPTION OF THE DRAWINGS

The sole figure is a schematic view of the components of the drive for a three-axle workpiece handling device in accordance with the present invention.

DETAILED DESCRIPTION OF THE DRAWINGS

With reference now to the sole figure, a mains contactor 1 supplies voltage to the entire illustrated arrangement. The mains contactor 1 is followed by a supply and feedback unit 2 in which the alternating voltage from the mains is rectified. By virtue of the supply and feedback unit 2, the braking energy generated by the press can be transmitted via the mains also to other consuming devices. That is, the press can be operated more economically.

Behind the supply and feedback device 2, capacitors 3 are arranged in an intermediate circuit designated generally by numeral 13 and store the electric braking energy generated by the press and the workpiece handling devices. Of course, it is to be understood that the capacitors 3 can also be charged by the normal power supply system within the scope of the present invention. In a controlled DC/DC-converter 4 which is arranged behind the capacitors 3, the voltage rectified by the supply and feedback unit 2 is converted into suitable voltages for the operation of different components of the illustrated drive, for example, of the control 5 for the individual drives of conventional workpieces handling devices (not shown for purposes of clarity) or for angle step generators 6 for each individual axle of the workpiece handling device.

Because, as mentioned above, the workpiece handling devices described in the present embodiment are known three-axle workpiece handling devices, three angle step generators 6 are required. That is, a separate angle step generator 6 is required for each axle, with each individual axle being driven by a separate driving motor 7. Of course, it is to be understood that the described arrangement may also be applied to workpiece handling devices with more or fewer than three axles.

The driving motors 7 for the individual axles of the workpiece handling devices are usually constructed as pulse-converter-fed asynchronous machines or brushless direct-current drives. Therefore, transistor pulse converters 8 are arranged parallel to the controlled DC/DC-converter 4, thereby providing the driving motors 7 in the illustrated embodiment as pulse-converter-fed asynchronous machines. Also, the main drive 9 of the press is also connected to the control 5 and is supplied with a suitable voltage by the above-described devices for the voltage supply.

For the main drive 9 of the press, the direct current from the intermediate circuit 13 is converted by a transistor pulse converter 8 into alternating current. In order to be able to permanently determine and transmit the position of the main drive 9 of the press to the control 5, two absolute-value angle generators 10, 11 are provided. In addition, holding magnet brakes 12 are provided which, if no voltage is applied thereto, hold the axles of the respective workpiece handling devices in their braked position.

With such an arrangement of the individual drive components as described above, a power supply system failure which occurs unexpectedly causes the press slide to be separated from its drive by way of a coupling. The press slide continues to move, as a function of the momentary stroke number, with a specific slow-down path. In order then to maintain the coordinated or synchronized movement of press slides and workpiece handling devices, the workpiece handling devices, despite the absent mains energy, must be able to follow the slow-down movement of the press slide with the assigned position values.

All components important for the movement of the workpiece handling devices, thus particularly the control 5 and the driving motors 7 with all devices required for this purpose, are now supplied with the stored energy from the capacitors 3 of the intermediate circuit 13. The intermediate-circuit direct-voltage is converted in the transistor pulse converters 8 into alternating voltage for the driving motors 7 of the individual axles of the workpiece handling devices and, in the controlled DC/DC-converter 4, is converted into a voltage suitable for the voltage supply of other required components, for example, the supply voltage for the control 5. Thus, the synchronous operation of the press slides and the workpiece handling devices can be maintained until the slide stands still and the workpiece handling devices are in a collision-free area.

By way of the absolute-value angle generators 10, 11, the position of the press slide and by way of the angle step generator 6, the positions of the driving motors 7 are queried and transmitted to the control 5. From this defined synchronous holding position, a restarting of the press can be carried out without any problems.

After the power supply is applied again, the now discharged capacitors 3 can be recharged. As an alternative, however, the capacitors 3 may also be charged by moved parts on the press or the workpiece handling devices by the conversion of their kinetic energy into electric energy. Thus, for example, the kinetic energy of the flywheel of the press can advantageously be used for this purpose.

It can also be provided that, if it is determined by a suitable recognition device that a synchronous following of the moved components to the press stoppage is not possible, the collision-endangered components of the workpiece handling devices are only moved out of the collision area while the press slide is braked in an uncontrolled manner in order to avoid a damaging of the press or of press parts. That is, instead of maintaining the coordinated operation of the workpiece handling devices with the press slide to the stoppage, the workpiece handling devices are moved out of the collision area as quickly as possible.

The workpiece handling devices can be constructed, for example, as transfer systems having gripper rails, as suction traverses or workpiece insertion and/or removal devices. If the capacitors 3 are not changed, at the point in time of the power supply outage, they can advantageously, as mentioned above, be charged by way of the kinetic energy of the moved masses of the press in the generator operation of the driving motors 7 to the intermediate circuit 13. With this still available energy, as mentioned above, the necessary components of the drive can then still be supplied with voltage.

For economical reasons, the intermediate-circuit capacitors in the case of drive amplifiers are normally dimensioned to be small. For the described application, however, normally larger intermediate-circuit capacitors must be provided in order to have available sufficient energy for the illustrated drive of the workpiece handling devices in the case of a power supply outage. In this case, the selection of suitable capacitors is well within ordinary skill in the art.

In the normal operation, i.e., when the press is running and the intermediate-circuit capacitors are already charged, for example, a pulse-controlled resistor with energy conversion into heat or a power-supply-side pulse converter with power supply feedback discharge the braking energy of the press.

Instead of being obtained from the intermediate circuit 13, the energy for moving all endangered components of a press into a collision-free area can also be obtained from an uninterruptable power supply, for example, a battery, so that a collision of endangered components can also be avoided in this manner.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A process for supplying energy to electronically controlled drives for electromechanically driven and electronically controlled workpiece handling devices in and on a press having a slide, comprising the steps of, in the event of a power supply outage, supplying at least the workpiece handling devices with voltage by one of an intermediate circuit of a drive amplifier and a uninterruptable power supply, and supplying all devices essential for movement of the workpiece handling devices with the voltage from the one of the intermediate circuit and the uninterruptable power supply.

2. The process according to claim 1, wherein capacitors in the intermediate circuit of the drive amplifier are charged by one of kinetic energy of moved masses in and on the press and by applied power supply voltage.

3. The process according to claim 2, wherein the capacitors are charged by the energy of a press flywheel.

4. The process according to claim 1, wherein the workpiece handling devices, after determination of a power supply outage, are moved out of the collision area, with other moved components of the press being braked in an uncontrolled manner.

5. The process according to claim 4, wherein capacitors in the intermediate circuit of the drive amplifier are charged by one of kinetic energy of moved masses in and on the press and by applied power supply voltage.

6. The process according to claim 5, wherein the capacitors are charged by the energy of a press flywheel.

7. The process according to claim 1, wherein, after determination of a power supply outage, synchronous movement of the workpiece handling devices and other essential press parts of the press is maintained until the press stops.

8. The process according to claim 7, wherein capacitors in the intermediate circuit of the drive amplifier are charged by one of kinetic energy of moved masses in and on the press and by applied power supply voltage.

9. The process according to claim 8, wherein the capacitors are charged by the energy of a press flywheel.

10. The process according to claim 1, wherein the workpiece handling devices comprise transfer systems with gripper rails.

11. The process according to claim 10, wherein capacitors in the intermediate circuit of the drive amplifier are charged by one of kinetic energy of moved masses in and on the press and by applied power supply voltage.

12. The process according to claim 11, wherein the capacitors are charged by the energy of a press flywheel.

13. The process according to claim 10, wherein the workpiece handling devices, after determination of a power supply outage, are moved out of the collision area, with other moved components of the press being braked in an uncontrolled manner.

14. The process according to claim 10, wherein, after determination of a power supply outage, synchronous movement of the workpiece handling devices and other essential press parts of the press is maintained until the press stops.

15. The process according to claim 1, wherein the workpiece handling devices comprise suction traverses.

16. The process according to claim 15, wherein capacitors in the intermediate circuit of the drive amplifier are charged by one of kinetic energy of moved masses in and on the press and by applied power supply voltage.

17. The process according to claim 15, wherein the workpiece handling devices, after determination of a power supply outage, are moved out of the collision area, with other moved components of the press being braked in an uncontrolled manner.

18. The process according to claim 15, wherein, after determination of a power supply outage, synchronous movement of the workpiece handling devices and other essential press parts of the press is maintained until the press stops.

19. The process according to claim 1, wherein the workpiece handling devices comprise at least one of workpiece insertion devices and workpiece removal devices.

20. The process according to claim 19, wherein capacitors in the intermediate circuit of the drive amplifier are charged by one of kinetic energy of moved masses in and on the press and by applied power supply voltage.

* * * * *